United States Patent [19]

Shaffer et al.

[11] 3,985,257

[45] Oct. 12, 1976

[54] BLOW MOLDED INDUSTRIAL DRUM

[75] Inventors: James B. Shaffer, Naperville, Ill.; Daniel Tomo, Cincinnati, Ohio; Chester Strohecker, Arthur, Ill.

[73] Assignee: National Distillers and Chemical Corporation, New York, N.Y.

[22] Filed: Mar. 3, 1975

[21] Appl. No.: 554,376

[52] U.S. Cl. ..... 220/1 R; 220/72; 220/DIG. 1

[51] Int. Cl.[2] ..... B65D 7/42; B65D 1/00

[58] Field of Search ..... 220/1 R, 1 B, 1 E, 5 R, 220/71, 72, DIG. 1, 288; 206/503

[56] References Cited

UNITED STATES PATENTS

| | | | |
|---|---|---|---|
| 2,351,387 | 6/1944 | Anderson | 220/72 |
| 3,647,110 | 3/1972 | Hammes | 220/72 |
| 3,827,595 | 8/1974 | Reynolds | 220/1 R |
| 3,871,549 | 3/1975 | Kerr | 220/288 |

FOREIGN PATENTS OR APPLICATIONS

| | | | |
|---|---|---|---|
| 248,588 | 12/1963 | Australia | 220/DIG. 1 |

*Primary Examiner*—William Price
*Assistant Examiner*—Steven M. Pollard
*Attorney, Agent, or Firm*—Kenneth D. Tremain

[57] ABSTRACT

An industrial sized drum that may be blow-molded of polyethylene is constructed with integrally formed rolling hoops, a domed top having an interrupted chime of generally arcuate cross-section undercut on its interior side, necks extending upward from a pair of diametrically opposed bungholes, symmetrically disposed dimples in the drum top adjacent these necks to maintain ovalization. The necks are formed to facilitate crimp-type securement of closures by crimp-type techniques. The drum bottom is formed with a chime and a sump pad aligned with one of the bungholes.

5 Claims, 8 Drawing Figures

FIG. 1.
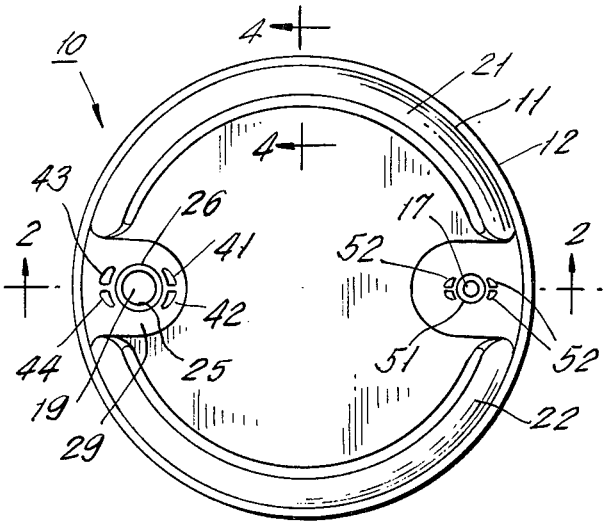
FIG. 4.
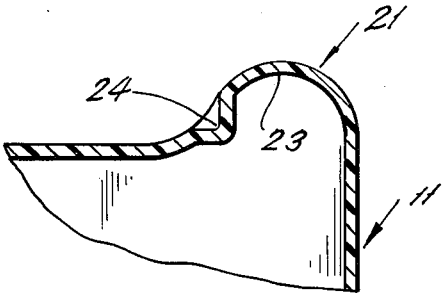
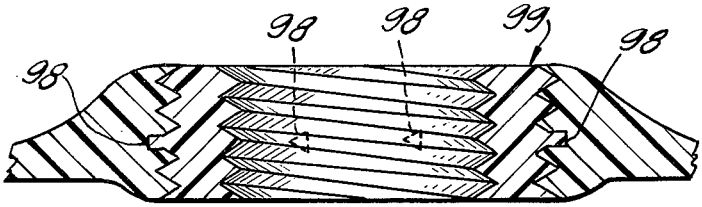
FIG. 8.
FIG. 2.
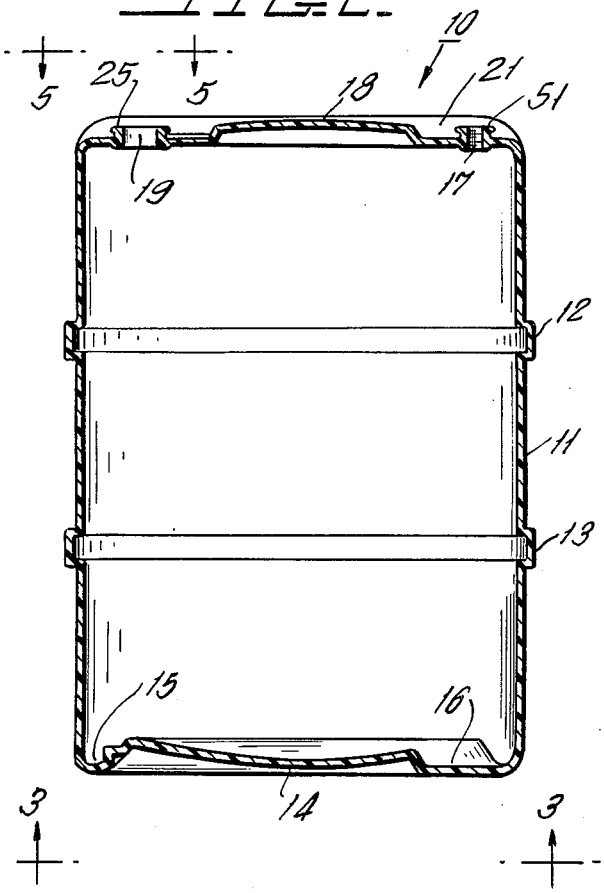
FIG. 3.
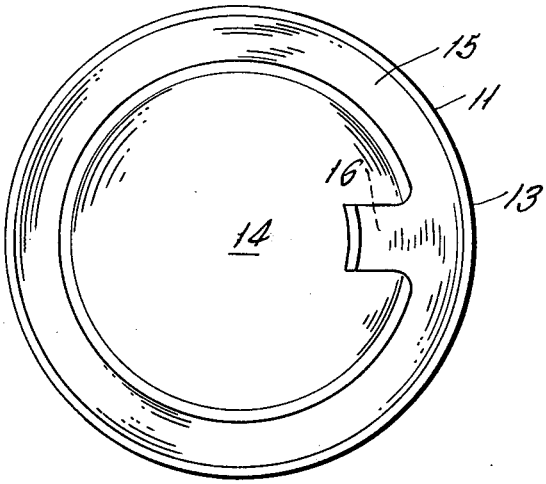

BLOW MOLDED INDUSTRIAL DRUM

This invention relates to industrial sized drums in general and relates more particularly to a plastic molded drum of this type.

Traditionally, industrial products in liquid form have been stored and shipped in steel drums having a capacity in the order of from 55 to 60 gallons. Drums used for corrosive liquids had to be provided with non-corrosive linings. Steel drums having limited impact resistance are relatively heavy even when empty.

In order to overcome the deficiency of steel drums, the instant invention provides a construction for a plastic drum that is suitable for manufacture by a blow molding process. The plastic utilized is, preferably, high molecular weight polyethylene having added thereto anti-oxidant ingredients, ultraviolet light stabilization ingredients, and color pigments. An industrial sized drum constructed of such material will withstand greater impact without leaking than will a steel drum and is lighter in weight than a steel drum. Since this plastic is inert to most materials, there is no need to provide a non-corrosive liner. Further, plastic drums will not corrode because of exposure to weather, so that they may be stored outdoors and may be shipped in uncovered trucks and rail cars.

In particular, the plastic drum of the instant invention is provided with a pair of hoops to facilitate rolling of the drum and is provided with chimes at the top and bottom that may be hand-gripped or may be used for attaching drum handling and tripping devices. Rolling hoops also function as separators of drums, i.e. keep drums from rubbing against one another during transit minimizing scuffing. The top is domed, and the chimes are interrupted to facilitate runoff of rain water and condensation. Since the plastic is flexible, the hoops can be deformed during loading of a truck and in some instances the deformating permits an extra drum row to be placed in the truck. Each chime is of generally arcuate cross-section having an undercut at the internal side of the chime to facilitate gripping thereof.

In addition, the top is provided with a pair of bungholes, each surrounded by an upwardly extending neck having formations to facilitate crimp-type securement of bunghole closures. Directly below one of the bungholes, the bottom of the drum is depressed, to provide a sump pad that permits more complete emptying of the drum when utilizing a pump. Ovalization of the bungholes is controlled by dimples or indentations near the mold parting line at the holes. These indentations reduce the thickness of material buildup near the parting line and provide an area of deformation as shrinkage takes place during setting of the plastic. These indentations also increase the area in contact with the cool mold, thereby assisting to cool this thicker section. Necks for the bungholes may be secured by insert molding, spin welding, and heat welding techniques.

The design of the drum is such that by utilizing interchangeable center sections for the mold, different capacity drums may readily be blow-molded. Further, the mold may have movable top and bottom sections to permit undercuts to be formed in the chimes.

Accordingly, a primary object of the instant invention is to provide a novel construction for a plastic drum of industrial capacity.

Another object is to provide a drum of this type that is manufactured by blow-molding.

Still another object is to provide a drum of this type having chimes constructed to facilitate gripping thereof.

A further object is to provide a drum of this type having means to prevent ovalization of bungholes.

A still further object is to provide a drum of this type having a top construction which facilitates water runoff and a bottom that includes a sump pad to facilitate emptying of the drum by utilizing a pump.

Yet another object is to provide a drum of this type that can replace a more expensive steel drum and is compatible with available equipment for handling conventional steel drums.

These objects as well as other objects of this invention shall become readily apparent after reading the following description of the accompanying drawings in which:

FIG. 1 is a plan view of a plastic drum constructed in accordance with teachings of the instant invention.

FIG. 2 is a cross-section taken through line 2—2 of FIG. 1 looking in the direction of arrows 2—2.

FIG. 3 is a bottom view looking in the direction of arrows 3—3 of FIG. 2.

FIG. 4 is an enlarged cross-section of the top chime taken through line 4—4 of FIG. 1, looking in the direction of arrows 4—4.

FIG. 8 is a cross-section taken through a diameter of an insert-molded plastic threaded insert.

Figure 5:
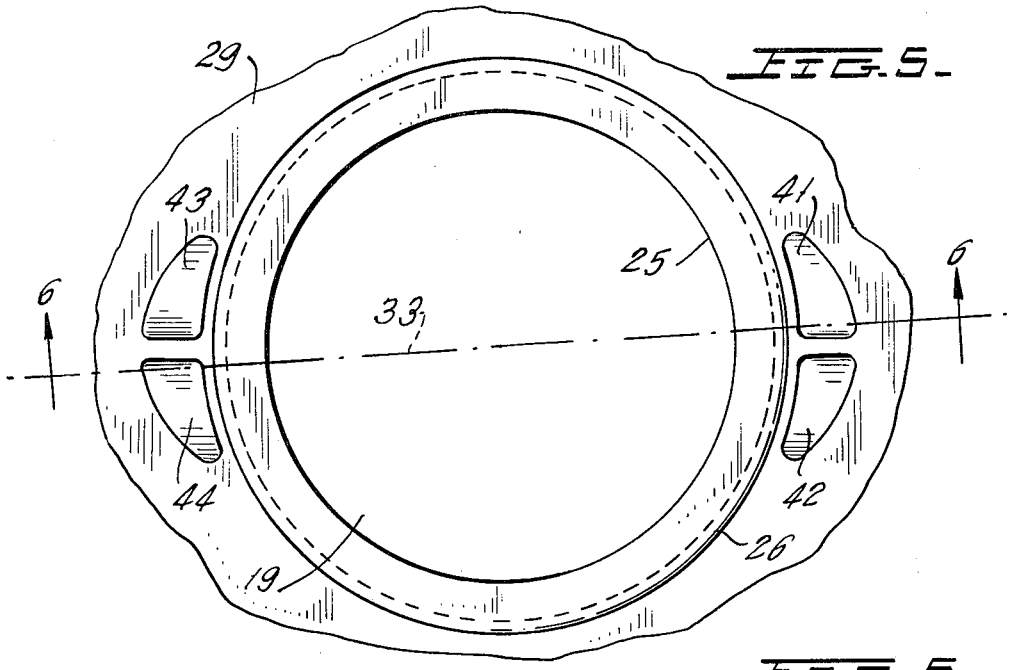
FIG. 5 is an enlarged plan view of the neck surrounding the larger bunghole.

Now referring to the figures. Plastic drum 10 is provided with generally cylindrical sidewall 11 having a pair of axially spaced outward protrusions 12, 13 constituting deformable rolling hoops each of which is of generally rectangular cross-section (FIG. 2) having relatively sharp exterior corners. The periphery of drum bottom 14 is provided with chime 15 and sump pad forming depression 16 that extends inward from chime 15. Sump pad 16 is located directly below smaller bunghole 17 in domed top 18 of drum 10. Another larger bunghole 19 in top 18 is diametrically opposite bunghole 17.

Bungholes 17, 19 extend through flat, depressed regions 27, 29, respectively, which provide interruptions that space the ends of top chime sections 21, 22. In cross-section (FIG. 4) major portion 23 of chime section 21 in arcuate, but section 24 thereof adjacent the main domed section of top 18 is undercut to facilitate gripping of chime section 21. Chime section 22 as well as lower chime 15 are constructed with undercuts similar to that described for chime section 21.

Figure 6:
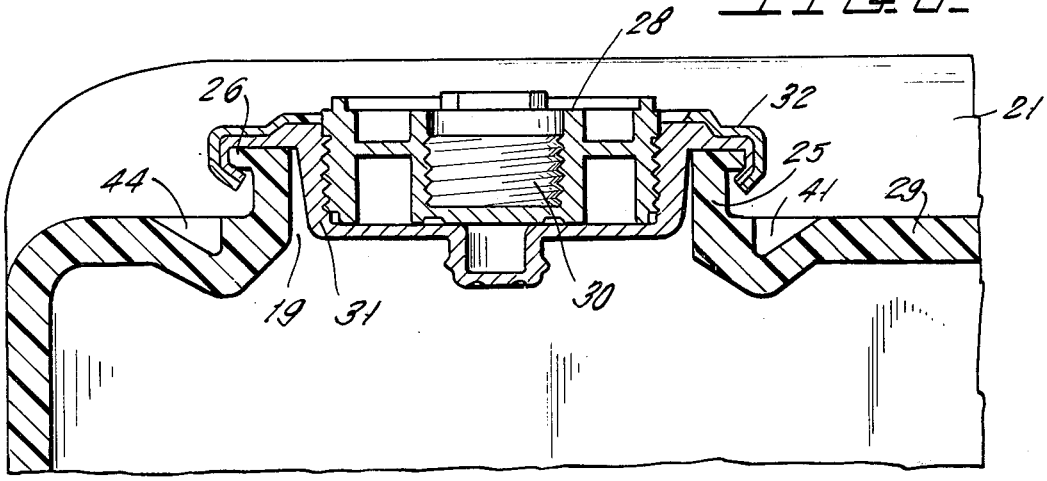
FIG. 6 is a cross-section taken through line 6—6 of FIG. 5, looking in the direction of arrows 6—6 with a bunghole closure in place.
Figure 7:
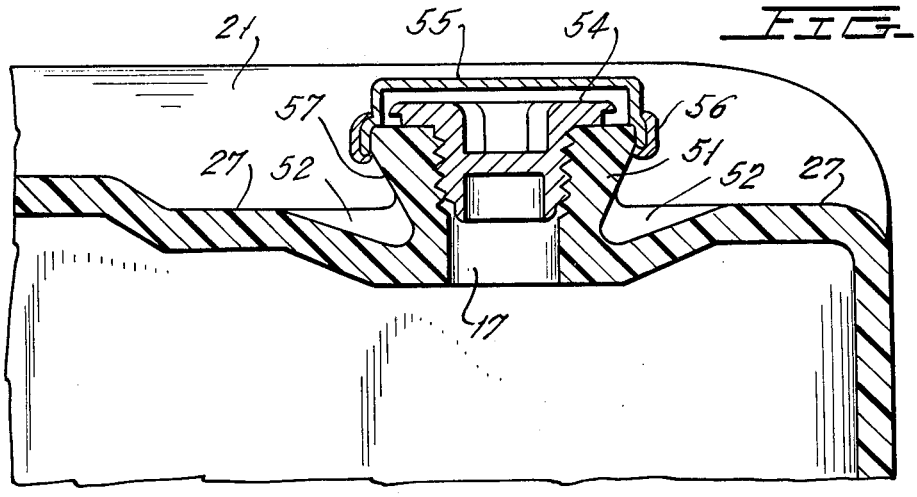
FIG. 7 is an enlarged cross-section taken through a diameter of the smaller bunghole showing a closure mounted thereover.

As seen best in FIG. 6, neck 25 extends upward from the boundary of bunghole 19 and the upper free end of neck 25 is provided with out-turned flange 26 to facilitate crimp-connecting of holder 31. The latter is internally threaded to engage external threads of outer fitting part 28 whose internal threads removably secure threaded plug 30. The central portions of elements 28 and 31 are frangible, and are intended to be broken away for emptying the contents of drum 10 through bunghole 19. Crimped ring 32 overlies the periphery of holder 31 for further securement thereof.

Dashed line 33 in FIG. 5 represents a parting line between certain elements forming the mold (not shown) in which drum 10 is formed. Surface 29 is provided with dimples 41, 42 disposed adjacent neck 25 and formed symmetrically with respect to parting line 33. Diametrically opposed to dimples 41, 42 is another pair of dimples 43, 44 disposed on opposite sides of parting line 33 and symmetrical with respect thereto. Dimples 41–44 help to maintain ovality of bunghole 19 during production of drum 10.

Similarly, smaller bunghole 17 is surrounded by upwardly extending neck 51 having reversely slanted outer surface 57. Flattened surface 27 is provided with a plurality of dimples 52, 52, etc. adjacent neck 51 and symmetrically disposed with respect to mold element parting line 33 or certain mold elements. The internal surface of neck 51 is threaded and removably receives threaded closure 54. Tamperproof seal 55 overlies closure 54 and extends slightly below the upper free end of neck 51 and is secured thereto by crimped ring 56. Closure supporting necks 25, 51 may be insert molded or may be secured by heat or spin welding.

Also in accordance with this invention is the utilization of plastic insert 99 (FIG. 8) in place of fitting part 28 and crimped ring 32. Insert 99 is an annular member, injection-molded of high density polyethylene, and having internal and external threads as well as a plurality of circumferentially spaced lugs 98 projecting outwardly from the external threads. Insert 99 is preheated and is insert-molded to appear as an integral part of the drum. Typically, the preheat of insert 99 is to approximately 150° F. with the parison for blow-molding the drum being at approximately 375° to 450° F.

Although there have been described preferred embodiments of this novel invention, many variations and modifications will now be apparent to those skilled in the art. Therefore, this invention is to be limited not by the specific disclosure herein, but only by the appending claims.

The embodiments of the invention in which an exclusive privilege or property is claimed are defined as follows:

1. A drum blow-molded of plastic, said drum including a tubelike sidewall, a top and a bottom at opposite ends of said sidewall, a plurality of rolling hoops projecting outward from said sidewall, a hand-engageable top chime along the periphery of said top and a hand-engageable bottom chime along the periphery of said bottom, first and second bungholes in said top surrounded by respective first and second outwardly extending necks, said bungholes being located at depressed regions of said top that communicate with drainage interruptions in said top chime, and a sump pad formed in said bottom in alignment with one of said bungholes, each of the depressed regions being provided with a plurality of dimple formations symmetrically disposed about each of said first and second necks to maintain ovality of said necks during molding thereof.

2. A drum as set forth in claim 1 in which the portion of the top inside the top chime is outwardly domed.

3. A drum as set forth in claim 2 in which said necks are provided with formations to which closures for said bungholes are secured by utilizing crimp-type securing means.

4. A drum as set forth in claim 3 in which a cross-section of the top chime is generally arcuate and is undercut in the interior side thereof along its bottom region.

5. A drum blow-molded of plastic, said drum including a tubelike sidewall, a top and a bottom at opposite ends of said sidewall, a plurality of rolling hoops projecting outward from said sidewall, a hand-engageable top chime along the periphery of said top and a hand-engageable bottom chime along the periphery of said bottom, first and second bungholes in said top surrounded by respective first and second outwardly extending necks, said bungholes being located at depressed regions of said top that communicate with drainage interruptions in said top chime, and a sump pad formed in said bottom in alignment with one of said bungholes, said top chime having a cross-section that is generally arcuate and is undercut in the interior side thereof along its bottom region.

* * * * *